US005325115A

United States Patent [19]

Tanahashi

[11] Patent Number: 5,325,115

[45] Date of Patent: Jun. 28, 1994

[54] INK RIBBON FOR COLOR PRINTER

[75] Inventor: Makoto Tanahashi, Tokyo, Japan

[73] Assignee: Sony Corporation, Tokyo, Japan

[21] Appl. No.: 966,443

[22] Filed: Oct. 26, 1992

[30] Foreign Application Priority Data

Oct. 30, 1991 [JP] Japan ..... 3-283429

[51] Int. Cl.[5] ..... B41J 2/325

[52] U.S. Cl. ..... 346/76 PH; 400/240; 400/240.3; 400/240.4; 400/237

[58] Field of Search ..... 346/76 PH; 400/240, 400/240.4, 240.3, 237, 207, 208, 208.1

[56] References Cited

U.S. PATENT DOCUMENTS 4,642,655 2/1987 Sparer et al. ..... 400/240.3
4,797,016 1/1989 Lahr ..... 400/237
4,970,531 11/1990 Shimizu et al. ..... 400/208

FOREIGN PATENT DOCUMENTS 0154193 12/1980 Japan ..... 400/237
0073888 4/1985 Japan ..... 400/240.3
0286184 12/1986 Japan ..... 400/237
0003987 1/1988 Japan ..... 400/237
0238953 9/1989 Japan ..... 400/207

*Primary Examiner*—Benjamin R. Fuller
*Assistant Examiner*—Huan Tran
*Attorney, Agent, or Firm*—Hill, Steadman & Simpson

[57] ABSTRACT

An ink ribbon for a color printer is provided which comprises a plurality of full color image strip portions each provided for printing a full color image on one sheet of printing paper during printing operation, each full color image strip portion including a plurality of ink color blocks applied with color inks different from each other, and marks, printed on blank portions in front of the ink color blocks so as to allow a printing operator to determine the color of the ink color blocks and the number of the used full color image strip sections. The marks may alternatively be provided on side areas of or blank portions in the ink color blocks respectively.

6 Claims, 4 Drawing Sheets

INK RIBBON FOR COLOR PRINTER

BACKGROUND OF THE INVENTION

1. Field of the Invention

The present invention relates generally to an ink ribbon which may be employed in a color printer so as to allow a user to know the color of an image before printing and/or an amount of ribbon which has been used.

2. Description of the Prior Art

Japanese Patent First Publication No. 62-297184 discloses an ink ribbon utilized for continuous color printing in a thermal color printer. The ink ribbon is permeated with three ink color blocks, such as yellow (Y), magenta (M), and cyan (C) (or four ink color blocks further including black (B)). The three ink color blocks overlap each other on one sheet of printing paper during printing operation so that a desired full color image may be printed.

Such an ink ribbon is usually accommodated in a ribbon cartridge for convenience. Single and double reel types of ribbon cartridge are well known in the art. The single reel type ribbon cartridge includes therein only one ribbon supply reel, a ribbon take-up reel is provided in a printer. The double reel type ribbon cartridge includes therein both ribbon supply and take-up reels winding a ribbon therebetween.

In operation, when the ribbon cartridge is loaded into a color video printer, it engages a ribbon feeding mechanism including capstan and pinch rollers so that the ink ribbon is extracted from the supply reel toward the take-up reel at a constant speed. During this operation, a platen lapped with a sheet of printing paper rotates repeatedly in normal and reverse directions so that the three colors are printed sequentially on the printing paper overlapping each other.

In a such conventional color printer, a ribbon cartridge which is coupled with a set number of sheets of a special printing paper is usually used. Thus, an amount of the unused ribbon may deduced by counting the number of unprinted sheets of paper. This is however quite inconvenient for a use and it is difficult to know an exact amount of unused ribbon accurately.

Further, there has been recently proposed a new type of thermal color printer which may utilize regular sheets of printing paper. Therefore, in such a color printer, since the ribbon cartridge need not be matched with sets of a particular type of paper, a user cannot determine an amount of unused ribbon by checking the remainder of printing paper and printing operation may become disrupted, further inconveniencing the user.

SUMMARY OF THE INVENTION

It is therefore a principal object of the present invention to avoid the disadvantages of the prior art.

It is another object of the present invention to provide an improved ink ribbon for a color printer which allows a user to know the color of an image before printing and/or an amount of ribbon which has been used easily.

According to one aspect of the present invention, there is provided an ink ribbon for a color printer which comprises a plurality of full color image strip portions each provided for printing a full color image on one sheet of printing paper during printing operation, each full color image strip portion including a plurality of ink color blocks applied with color inks different from each other, and marks, printed on preselected areas of the ink ribbon, for indicating the color of the ink color blocks and the number of the used full color image strip portions.

According to another aspect of the present invention, there is provided a color printer which comprises a ribbon cartridge storing an ink ribbon which comprises a plurality of full color image strip portions each provided for printing a full color image on one sheet of printing paper during printing operation, each full color image strip portion including a plurality of ink color blocks applied with color inks different from each other, and marks, printed on preselected areas of the ink ribbon, for indicating the color of the ink color blocks and the number of the used full color image strip sections, and an opening provided in the printer so as to allow an operator to see the marks of the ink ribbon.

In the preferred mode, the marks may be printed on blank portions provided in front of the ink color blocks respectively. Alternatively, the marks may be printed on preselected side areas of the ink color blocks respectively. Further, the marks may be printed on blank portions provided on preselected areas in the ink color blocks respectively. Additionally, the marks may include characters and numerals respectively, the characters indicating the color of the ink color blocks, the numerals indicating the number of the used full color image strip portions.

BRIEF DESCRIPTION OF THE DRAWINGS

The present invention will be understood from the detailed description given hereinbelow and from the accompanying drawings of the preferred embodiment of the invention which are not intended to limit the invention to the specific embodiment but are for explanation and understanding only.

In the drawings:

FIG. 1(*b*) is a plane view which shows a modification of an ink ribbon as shown in FIG. 1(*a*).

FIG. 2(*b*) is a plane view which shows a modification of an ink ribbon as shown in FIG. 2(*a*).

FIG. 3(*b*) is a side view which shows a ribbon cartridge as shown in FIG. 3(*a*).

DESCRIPTION OF THE PREFERRED EMBODIMENT

Figure 1:
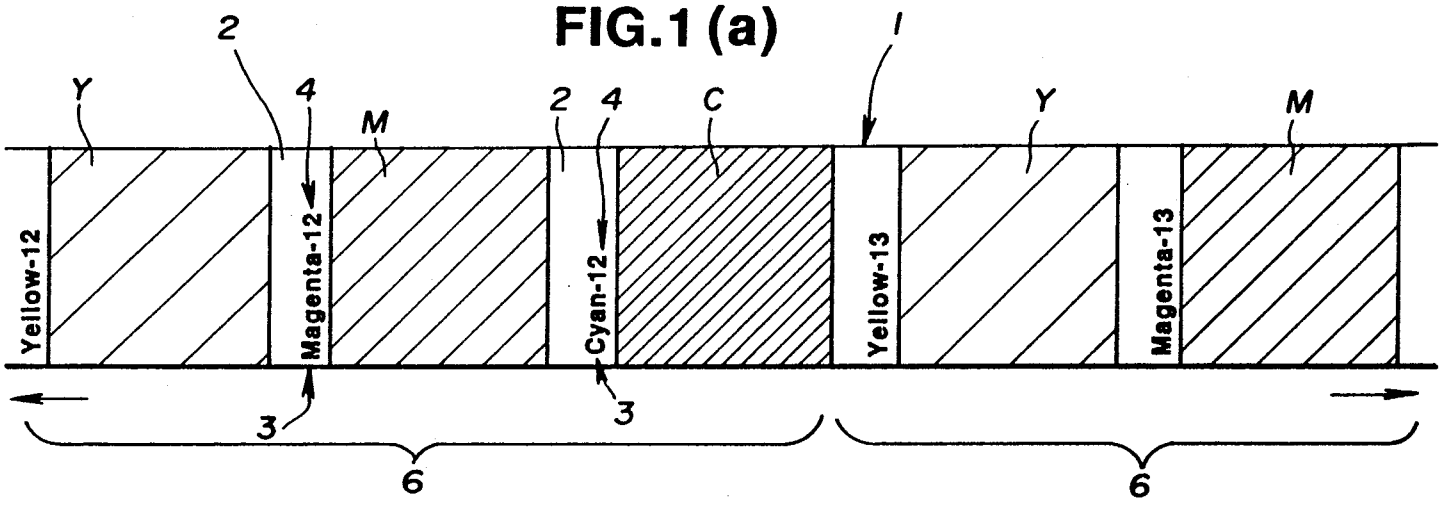
FIG. 1(*a*) is a plane view which shows an ink ribbon according to the present invention.
Figure 1:
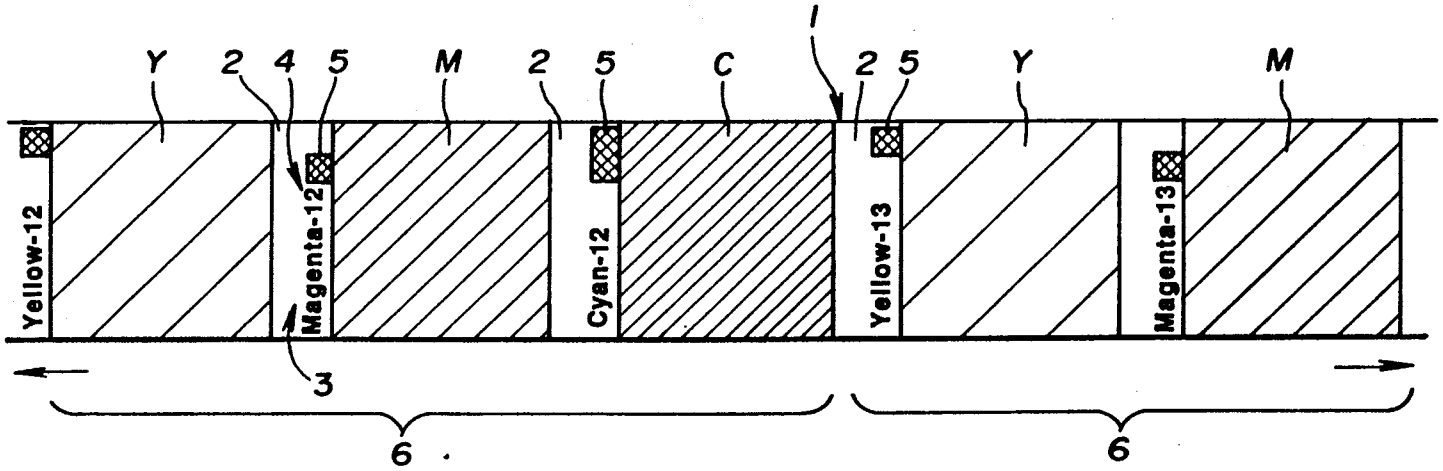

Referring now to the drawings, wherein like numbers refer to like parts in the several views, particularly to FIG. 1(*a*), there is shown an ink ribbon 1 for continuous color printing according to the present invention. The ink ribbon 1 includes generally a plurality of full color image strip portions 6 each comprising three ink color blocks permeated with yellow (Y), magenta (M), and cyan (C) inks, or dyes. The three color ink blocks Y, M, and C overlap each other on one sheet of printing paper during printing operation so that a desired full color image may be printed. The ink ribbon 1 further includes blank portions 2 provided between each of the ink color blocks, characters 3 indicating the color of each ink color block and numerals 4 representing serial number assigned for the full color image strip portions 6 (corresponding to the number of sheets of printed paper). The characters 3 and the numerals 4 are printed on the blank portions 2 adjacent front edges (i.e., leading edges) of the ink color blocks Y, M, and C, showing "Yellow-12", "Magenta-12", "Cyan-12", "Yellow-13", "Magenta-13", etc. in the illustrated manner. The ink ribbon may alternatively be provided with four color ink blocks including black.

Referring to FIG. 1(*b*), there is shown a modification of the ink ribbon as shown in FIG. 1(*a*). The shown ink ribbon further includes color identifying marks 5 each printed on the blank portion 2 adjacent the characters 3 and numeral 4. The color identifying marks 5 are provided with marking of two bits representing the above three ink colors.

Figure 2A:
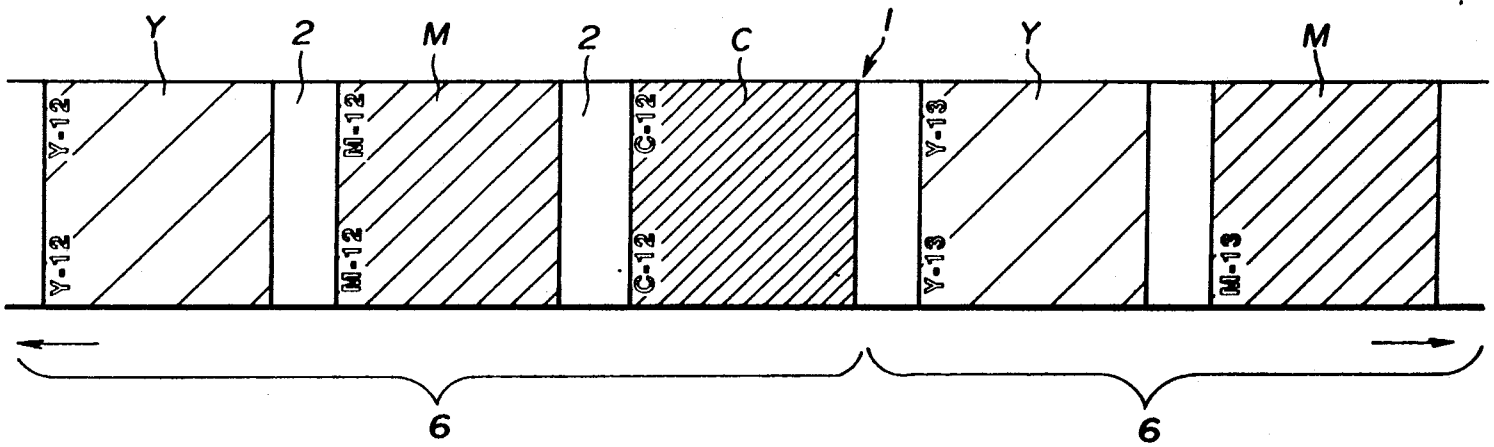
FIG. 2(*a*) is a plane view which shows an ink ribbon of an alternative embodiment.
Figure 2B:
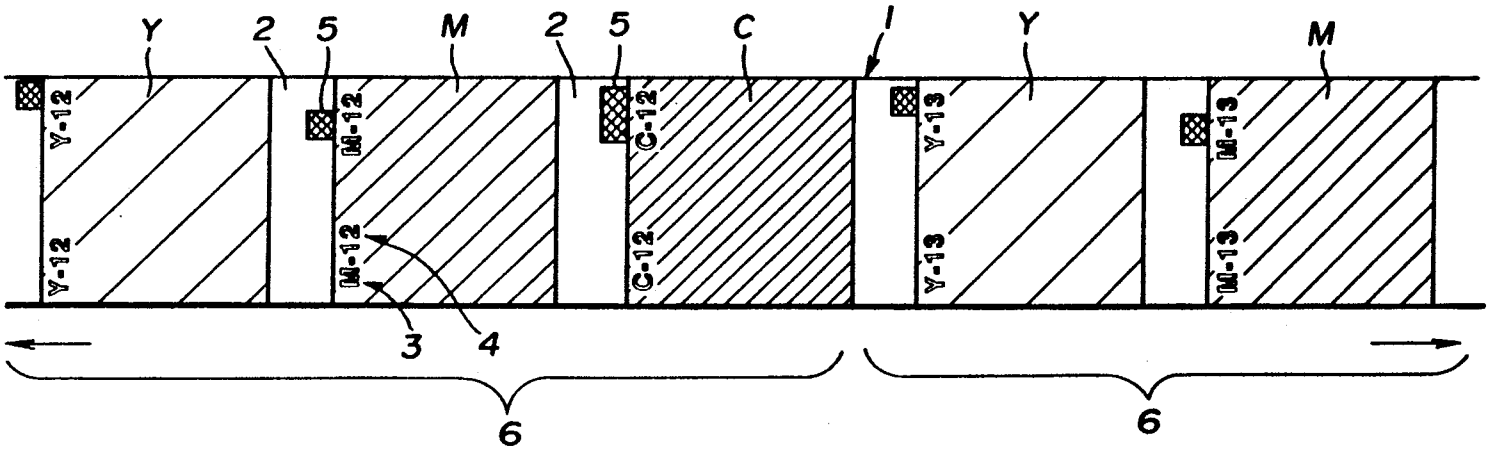

Referring to FIGS. 2(*a*) and 2(*b*), there is shown an alternative embodiment of an ink ribbon of the invention. Similar to the above embodiment, the ink ribbon 1 includes a plurality of full color image strip portions 6 each comprising three ink color blocks permeated with yellow (Y), magenta (M), and cyan (C) inks, blank portions 2 provided between the ink color blocks Y, M, and C, characters 3 indicating the color of the ink color blocks, and numerals 4 representing serial numbers assigned for the full color image strip portions 6. In this embodiment, the characters 3 and the numeral 4 are, as shown in the drawing, printed on blank areas provided on front corners of the ink color blocks Y, M, and C to read as "Y-12", "M-12", "C-13", "Y-13", "M-13", etc. The characters 3 include initial letters of words representative of the colors of the ink color blocks Y, M, and C respectively. The color identifying marks 5 are printed on the blank portions 2 in a manner similar to the first embodiment.

The characters 3 may alternatively be provided with any other suitable letters or marks. For example, Chinese characters may be used. Additionally, according to arrangement of an ink ribbon in a color printer, the characters 3 and the numeral 4 may be printed on a side area or a reverse surface of each ink color block respectively.

Figure 3A:
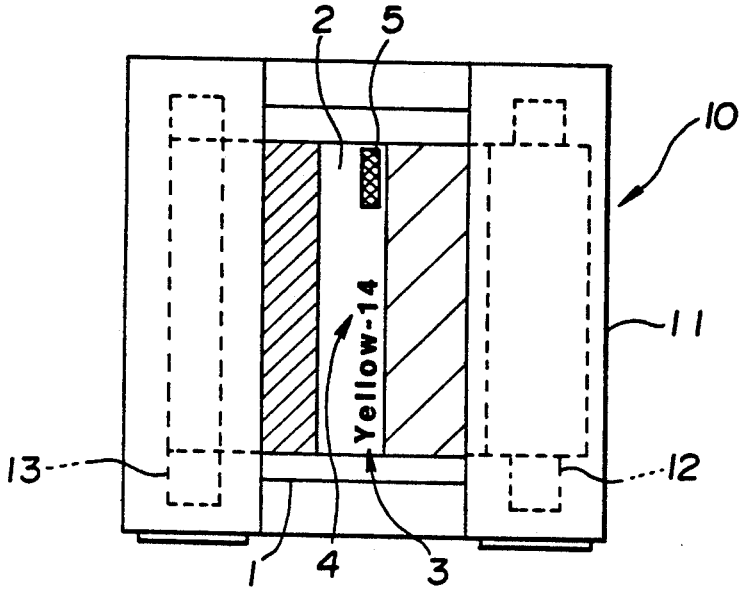
FIG. 3(*a*) is a plane view which shows a ribbon cartridge accommodating an ink ribbon according to the invention.
Figure 3B:
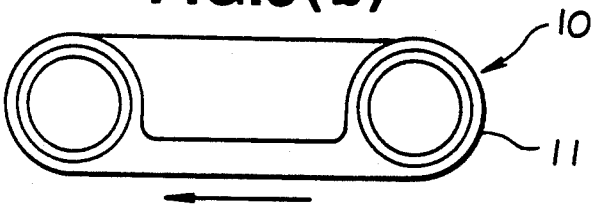

Referring to FIGS. 3(*a*) and 3(*b*), a ribbon cartridge 10 is shown which includes generally a cartridge casing 11, a ribbon supply reel 12, and a ribbon take-up reel 13. The shown ribbon cartridge 10 is a double reel type cartridge, as explained above, wherein the ribbon supply reel 12 and the ribbon take-up reel 13 are accommodated in internal spaces at both sides of the cartridge casing 11 winding the ink ribbon 1 therebetween. The cartridge casing 11 has an opening for exposing the ink ribbon 1 between the reels 12 and 13 so as to allow a printing operator to identify the color of the ink color block between the reels 12 and 13 and the number of used full color image strip portions 6 through the characters 3 and the numerals 4. Additionally, a color printer automatically detects the color identifying marks 5 by means of a photo sensor for example.

Figure 4:
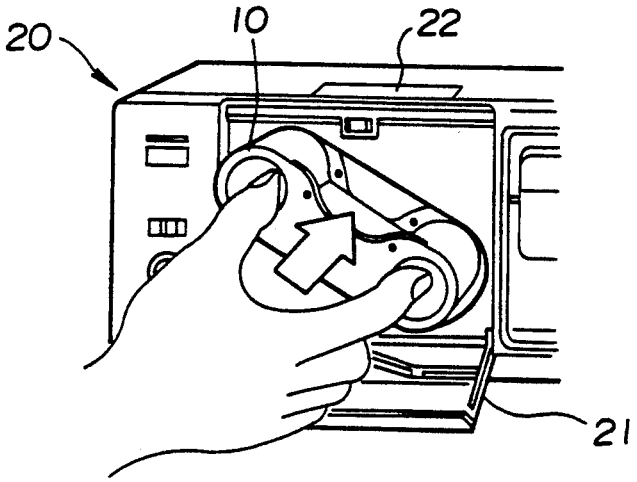
FIG. 4 is a perspective view which shows a color printer utilizing an ink ribbon of the invention.

Referring to FIG. 4, a color printer 20 is shown which utilizes an ink ribbon of the invention, as described above. When the ribbon cartridge 10 is loaded into the color printer, a ribbon door 21 is opened and the ribbon cartridge 10 is then loaded into the printer. The color printer 20 has a transparent window 22 provided in an upper surface of a printer casing so as to allow an operator to see the characters 3 and the numerals 4 at the window 22. Alternatively, since the ribbon cartridge is easy of loading into and unloading from the printer 20, the operator may take out the ribbon cartridge 10 directly from the printer 20 to see the characters 3 and the numerals 4. Additionally, when the inside of the color printer 20 is too dark to see the characters 3 and the numerals 4, a spotlight may be provided in the printer 20 for illuminating an outer surface of the ink ribbon. Further, a mirror may be utilized for easy observation.

Figure 5:
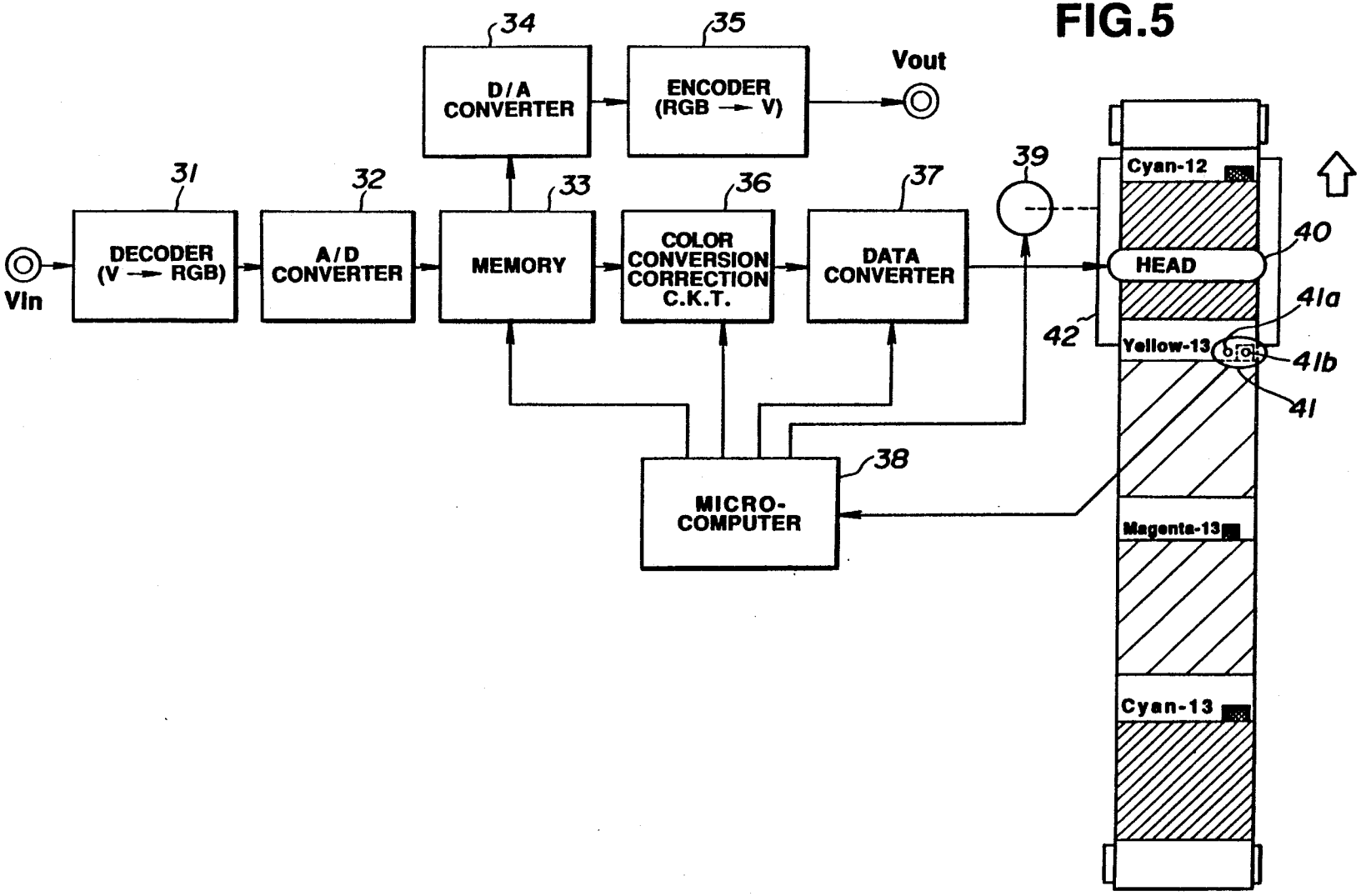
FIG. 5 is a block diagram which shows a printing system of a video color printer adapted for utilizing an ink ribbon according to the present invention.

Referring to FIG. 5, there is shown a thermal color video printing system utilizing the ink ribbon of the invention. This thermal color video printing system includes generally a decorder 31, an analog-to-digital (A/D) converter, a memory 33, a ditital-to-analog (D/A) converter 34, an encoder 35, a color conversion/color correction circuit 36, a printing data converter 37, a microcomputer 38, a motor 39, a thermal head 40, a color identifying sensor 41, and a sheet of printing paper 41.

Video signals (V) are input from an input terminal (Vin) to the decorder 31 and then modified into RGB signals (or Y, R-Y, B-Y). These signals are converted into digital signals through the A/D converter 32 and then stored in the memory 33 under control of the microcomputer 38. The digital signals from the memory 33 are input to the D/A and the color conversion/color correction circuit 36. In the D/A converter 34, the digital signals are converted into analog signals and then input into the encoder 35 wherein the RGB signals are modified into video signals (V) to be output from an output terminal (Vout) to a video monitor (not shown).

The thermal color video printing system further includes a color identifying sensor 41 which is arranged at a position suitable for detecting the color identifying marks 5 printed on the ink ribbon. The color identifying sensor 41 is provided with a pair of sensors 41*a* and 41*b* which are operable to detect the color of the ink ribbon being fed to the thermal head 40 at a constant speed by means of the motor 39 during printing and provide a sensor signal "Y", "M", or "C" to the microcomputer 38 for identifying the color of the ink ribbon (i.e., the color of an image printed on the printing paper 42). The color identifying sensor 41 provides a sensor signal indicating (0, 1), (1, 0), or (1, 1) wherein (0, 1) representing yellow (Y), (1, 0) representing magenta (M), and (1, 1) representing cyan (C). The microcomputer 38 outputs a reading out signal to the memory 33 which corresponds to the color detected by the color identifying sensor 41. The memory 33 is then responsive to the reading out signal to output the "RGB" signals to the color conversion/color correction circuit 36 so that the RGB signals are converted into signals indicating the colors of Y, M, or C with color correction. Afterwards, the printing data converter 37 converts the signals from the color conversion/color correction circuit 36 into image data signals for the thermal head 40. In this way, a desired full color image of interest to an printing operator is printed on the printing paper 42.

Generally, conventional thermal video printers utilize special sheets of printing paper. A ribbon cartridge coupled with a particular number of sheets of printing paper is usually used. Therefore, the remainder of an ink ribbon may be known by counting the number of sheets of printing paper.

However, when regular sheets of printing paper are used in place of special sheets of printing paper, it is difficult for a printing operator to know an amount of unused ribbon precisely during printing.

Accordingly, as mentioned above, according to the present invention, an ink ribbon is provided on which characters are printed in front of each ink color block of the ribbon which indicate the color of a subsequent ink color block and the remainder of the ribbon. It will be appreciated that after each printing operation for printing one sheet of printing paper, the characters on the ribbon appear at a position visible to a printing operator for determining an amount of used or unused ribbon easily.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. An ink ribbon for a color printer comprising:

a plurality of consecutive full color image strip portions for printing a full color image on one sheet of printing paper during printing operation, each of said full color image strip portions comprising a plurality of consecutive ink color blocks which extend completely across said ink ribbon and blank spaces formed between each of said ink color blocks and at least one character printed on said ink ribbon which indicates the color of the ink color blocks and a number printed on said ink ribbon which identifies each of said full color image strip portions that are used.

2. An ink ribbon for a color printer as set forth in claim 1, wherein said at least one characters and said number are printed in said blank spaces.

3. An ink ribbon for a color printer as set forth in claim 1, wherein said at least one character and said number are printed in said ink color blocks.

4. An ink ribbon for a color printer as set forth in claim 1, further comprising indicia which varies in size and position and is printed in said blank spaces, and which indicate the color of said ink color blocks.

5. An ink ribbon for a color printer comprising:

a plurality of full color image strip portions each provided for printing a full color image on one sheet of printing paper during printing operation, each of said full color image strip portions including a plurality of ink color blocks applied with color inks different from each other; and marks printed on preselected areas of the ink ribbon and include characters and numerals, the characters indicating the color of the ink color blocks, the numerals indicating the plurality of full color image strip portions that are used.

6. A color printer comprising:

a ribbon door through which a ribbon cartridge is loaded into a printer;

a ribbon cartridge storing an ink ribbon which comprises a plurality of full color image strip portions each provided for printing a full color image on one sheet of printing paper during printing operation, each of said full color image strip portions including a plurality of ink color blocks applied with color inks different from each other, and marks, printed on preselected areas of the ink ribbon, for indicating the color of the ink color blocks and the plurality of full color image strip portions that are used; and an opening provided in the printer so as to allow an operator to see said marks of the ink ribbon.

* * * * *